United States Patent [19]

Hattori et al.

[11] 4,106,451

[45] Aug. 15, 1978

[54] AIR-FUEL RATIO ADJUSTING SYSTEM FOR INTERNAL COMBUSTION ENGINES

[75] Inventors: Tadashi Hattori, Okazaki; Akira Takata; Tamotsu Fukuda, both of Toyota; Takamichi Nakase, Gamagori, all of Japan

[73] Assignees: Nippon Soken, Inc., Nishio; Toyota Jidosha Kogyo Kabushiki Kaisha, Toyota, both of Japan

[21] Appl. No.: 782,748

[22] Filed: Mar. 30, 1977

[30] Foreign Application Priority Data

| | | | |
|---|---|---|---|
| Apr. 13, 1976 | [JP] | Japan | 51-42145 |
| Apr. 13, 1976 | [JP] | Japan | 51-42147 |
| Apr. 19, 1976 | [JP] | Japan | 51-44653 |

[51] Int. Cl.[2] ..... F02B 75/10; F02M 7/00; F02B 3/00

[52] U.S. Cl. ..... 123/119 EC; 123/32 EE; 123/119 D; 123/124 B

[58] Field of Search ..... 123/32 EE, 32 EA, 119 EC, 123/119 D, 124 R, 124 B; 60/276

[56] References Cited

U.S. PATENT DOCUMENTS

| | | | |
|---|---|---|---|
| 3,827,237 | 8/1974 | Linder et al. | 123/119 EC |
| 3,923,016 | 12/1975 | Hoshi | 123/32 EE |
| 3,963,009 | 6/1976 | Mennesson | 123/119 EC |
| 4,019,470 | 4/1977 | Asano | 123/32 EE X |
| 4,022,171 | 5/1977 | Laprade et al. | 123/119 EC |
| 4,040,394 | 8/1977 | Wahl et al. | 123/32 EE |
| 4,052,968 | 10/1977 | Hattori et al. | 123/119 EC |

*Primary Examiner*—Wendell E. Burns
*Attorney, Agent, or Firm*—Cushman, Darby & Cushman

[57] ABSTRACT

An air-fuel ratio adjusting system controls the amount of additional air supply through the bypass passage of the carburetor to ensure optimum engine operation even in a warming up condition of the engine. The air-fuel ratio adjusting system includes an air-fuel ratio sensor disposed in the exhaust manifold, a warm-up sensor for detecting the temperature of engine cooling water or engine block, and a control unit for providing a control signal to a driving motor for the bypass valve. The bypass valve is controlled so that the air-fuel ratio of the mixture becomes the stoichiometric one and at the same time, during the warming up condition, the maximum opening of the bypass valve is limited to a predetermined degree depending on the temperature of the engine.

6 Claims, 13 Drawing Figures

AIR-FUEL RATIO ADJUSTING SYSTEM FOR INTERNAL COMBUSTION ENGINES

The present invention relates to air-fuel ratio adjusting systems for internal combustion engines, and more particularly the invention relates to an air-fuel ratio adjusting system for internal combustion engines equipped with an exhaust emission control system (e.g., a catalytic converter, etc.) which is designed to control the air-fuel ratio of the mixture at a value which ensures the optimum operation of the exhaust emission control system.

An air-fuel ratio adjusting system of this type has been proposed which comprises a sensor for detecting the oxygen content of exhaust gases, i.e., a so-called air-fuel ratio sensor disposed in the exhaust pipe of an internal combustion engine, a control unit for determining the magnitude of the air-fuel ratio of the mixture in accordance with the output signal of the air-fuel ratio sensor, a motor driven by the control unit, and a bypass valve coupled to the motor to control the passage area of an additional air passage of the carburetor, whereby the amount of additionally supplied correcting air is controlled to control the air-fuel ratio of the mixture supplied to the engine at around the stoichiometric air-fuel ratio.

With this prior art system, due to the fact that the sensor disposed in the exhaust pipe cannot function properly during the cold starting period of the engine (the period during which the temperature of the engine itself is low and the ignitability of the mixture is poor), the control of the bypass valve mounted in the additional air passage is temporarily stopped until the temperature of the engine rises to a value which allows the sensor to function properly.

However, this prior art system is disadvantageous in that if the control of the bypass valve is stopped until the engine warms up satisfactorily, due to the fact that the carburetor is adjusted to produce a mixture of a relatively small air-fuel ratio, the supply of excessively rich mixture is continued for a long period of time, and the unburned constituents of the exhaust gasses, i.e., CO and HC are emitted in large quantities.

Another disadvantage of this prior art system is that if the control of the bypass valve is started after the engine has warmed up slightly, the air-fuel ratio sensor is not in condition to function satisfactorily and it does not respond satisfactorily, with the result that the control of air-fuel ratio is not effected satisfactorily and the mixture becomes excessively lean, thus making it impossible to ensure proper operation of the engine and thereby causing backfiring, engine stalling or the like.

With the prior art system of this type, since a motor is generally employed as driving means for operating the bypass valve and the time rate of change of the controlled air-fuel ratio is dependent on the rate of change in the area of the additional air passage by the motor, the delay time between the instant of a change in the air-fuel ratio of the mixture in the intake system and the instant at which the sensor detects the change in the exhaust system has an effect on the control of air-fuel ratio, with the result that the lower the driving speed of the motor is, more satisfactorily the air-fuel ratio of the mixture is returned to a predetermined air-fuel ratio under the steady-state conditions, while the higher the driving speed of the motor is, more readily the air-fuel ratio of the mixture is returned to the predetermined air-fuel ratio under the transient conditions such as during periods of acceleraion and the like.

Consequently, in this prior art system, the motor driving speed is set to the optimum value so that the control range of air-fuel ratio is minimized under the steady-state conditions as well as the transient conditions.

However, this prior art system is disadvantageous in that since the control of air-fuel ratio is always effected continuously and the effects of other factors are not practically taken into consideration, even if the motor driving speed is set to the optimum value as mentioned above, due to the fact that the motor driving speed is constant, the effect of the delay time factor cannot be fully compensated by the control range of air-fuel ratio, thus causing trouble and making it impossible to ensure satisfactory control.

More specifically, during low load and speed operation where the amount of intake air is small, the delay time is increased thus causing a hunting phenomenon and thereby making it impossible to ensure a full display of the purification efficiency of the catalyst, and moreover during the running of the vehicle a surging phenomenon is caused and this results in a deteriorated drivability.

This may be attributed to the fact that the bypass valve used is of the type so that the amount of additional air is compensated for at the same rate throughout the range of flow rates from the low flow rate to the maximum flow rate, and as a consequence the compensation of the passage area by the bypass valve must be designed so that proper compensation is also provided in the maximum flow range. Consequently, during low load and speed operation where the amount of intake air is small, additional air is inevitably supplied excessively thus causing a greater hunting phenomenon and thereby giving rise to the previously mentioned problems. Particularly, during the time interval from the cold starting of the engine until the engine warms up, during starting periods and the like, the mixture is caused to become excessively lean causing such phenomena as backfiring and engine stalling.

Therefore, it is an object of the invention to provide an improved air-fuel ratio adjusting system for internal combustion engines equipped with exhaust emission control systems, which overcomes the foregoing deficiencies of the prior art systems.

It is another object of the invention to provide an improved air-fuel ratio adjusting system for internal combustion engines wherein the maximum opening of a bypass valve mounted in the intake system of the engine is controlled in accordance with the conditions of the engine during periods of warm-up operation, whereby efficient operation of the engine is ensured during warm-up periods, and the amounts of HC and CO emission in the engine exhaust gasses are reduced.

It is still another object of the invention to provide an improved air-fuel ratio adjusting system for an internal combustion engine of the type in which an additional air passage is provided in the intake system of the engine and a bypass valve is mounted in the passage to control its opening area, wherein the maximum opening of the bypass valve is controlled in accordance with the amount of air drawn into the engine or a parameter relating to the amount of intake air, whereby the air-fuel mixture supplied to the engine is prevented from becoming excessively lean during low speed and load operation of the engine to thereby prevent the occurrence of such phenomena as backfiring and engine stalling.

It is still another object of the invention to provide an improved air-fuel ratio adjusting system for an internal combustion engine of the type having an additional air passage for controlling the air-fuel ratio of the mixture and a bypass valve mounted in the passage to control its passage area, wherein the maximum opening of the bypass valve is controlled according to the conditions of the engine during warm-up operation and the amount of intake air (or a parameter related to the amount of intake air), whereby stable and efficient operation is ensured during the periods of warm-up, the CO and HC emissions in the exhaust gases are reduced during warm-up operation, and the air-fuel mixture supplied to the engine is prevented from becoming excessively lean during low speed and load operation of the engine.

These and other objects and many of the attendant advantages of the invention will be readily appreciated as the same becomes better understood by reference to the following detailed description when considered in connection with the accompanying drawings, in which.

The present invention will now be described in greater detail with reference to the illustrated embodiments.

Figure 1:
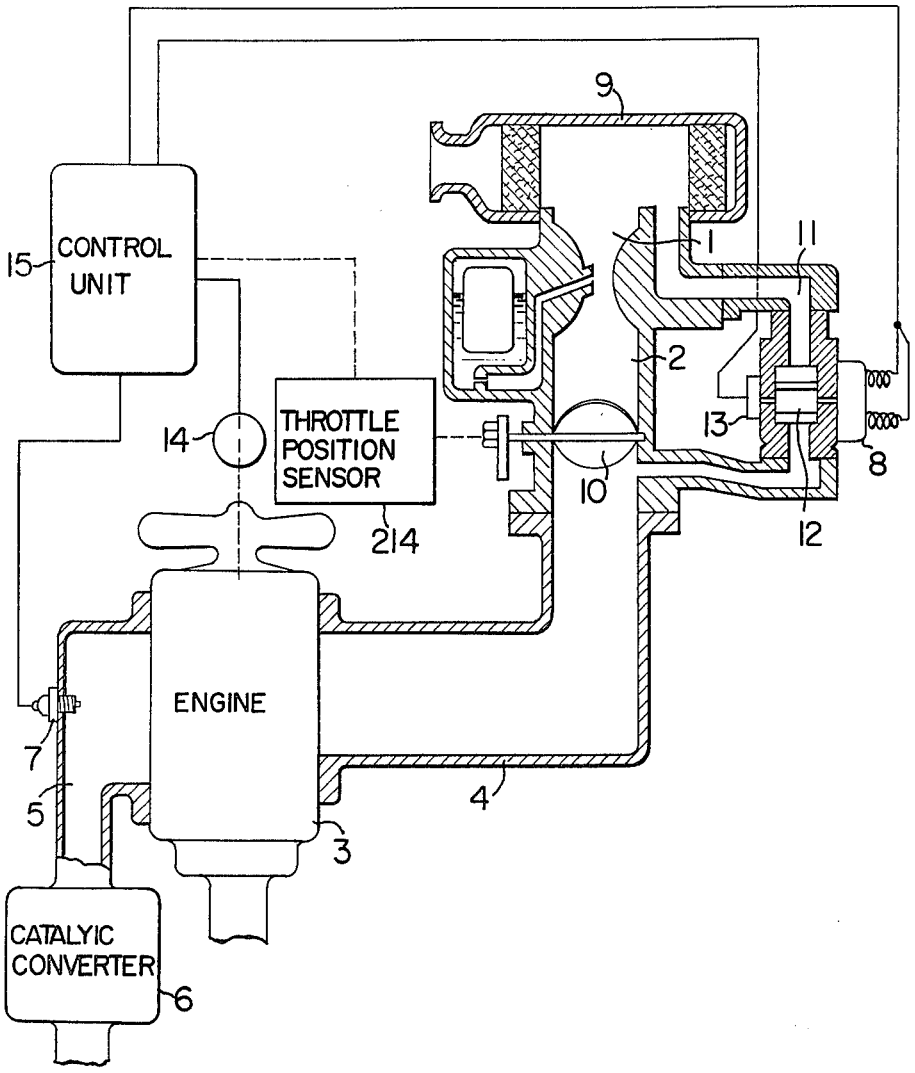
FIG. 1 is a sectional view schematically showing the entire system of an embodiment of the invention.

Referring first to FIG. 1 showing the first embodiment of the invention, numeral 1 designates a carburetor in which the passage area of a main mixture passage 2 is controlled by a throttle valve 10 linked to the accelerator pedal that is not shown, and an air cleaner 9 is communicated with an intake manifold 4 of an internal combustion engine 3. The carburetor 1 further comprises an additional air passage 11 communicating the air cleaner 9 with the main mixture passage 2 downstream of the throttle valve 10, a bypass valve 12 for controlling the passage area of the passage 11, driving means 8 comprising for example a pulse motor for operating the bypass valve 12 to adjust its opening, and a position sensor 13 comprising for example a potentiometer for detecting the opening of the bypass valve 12. Numeral 5 designates an exhaust manifold through which the exhaust gases from the engine 3 are discharged to the atmosphere by way of a three-way catalytic converter 6 and a muffler which is not shown. Numeral 7 designates an air-fuel ratio sensor disposed in the exhaust manifold 5 and comprising an oxygen content sensor employing zirconium dioxide or the like, and its output voltage characteristic is such that the electromotive force produced corresponds to the oxygen content of the exhaust gases, and particularly the electromotive force changes in a step fashion at around the stoichiometric air-fuel ratio. While, in the Figure, the air-fuel ratio sensor 7 is disposed in the exhaust manifold 5 upstream of the catalytic converter 6, it is of course possible to mount the sensor 7 in the exhaust manifold 5 downstream of the catalytic converter 6.

Numeral 14 designates a warm-up sensor for detecting the warming condition of the engine 3 to produce a signal, and it comprises a temperature sensor consisting for example of a negative characteristic thermistor which detects the cooling water temperature or the engine block temperature of the engine 3. A control unit 15 is responsive to the outputs of the air-fuel ratio sensor 7, the position sensor 13 and the warm-up sensor 14, so that during the normal operation of the engine 3, the relative magnitude of the air-fuel ratio of the mixture supplied to the engine 3 is determined in accordance with the oxygen content of the exhaust gases, and the opening of the bypass valve 12 is correspondingly adjusted by the pulse motor 8 such that the air-fuel ratio becomes the stoichiometric one, and while during the time interval from the cold starting of the engine until the engine warms up the maximum opening of the bypass valve 12 is controlled in such a manner that the bypass valve 12 is prevented from opening further from the maximum opening.

Figure 2:
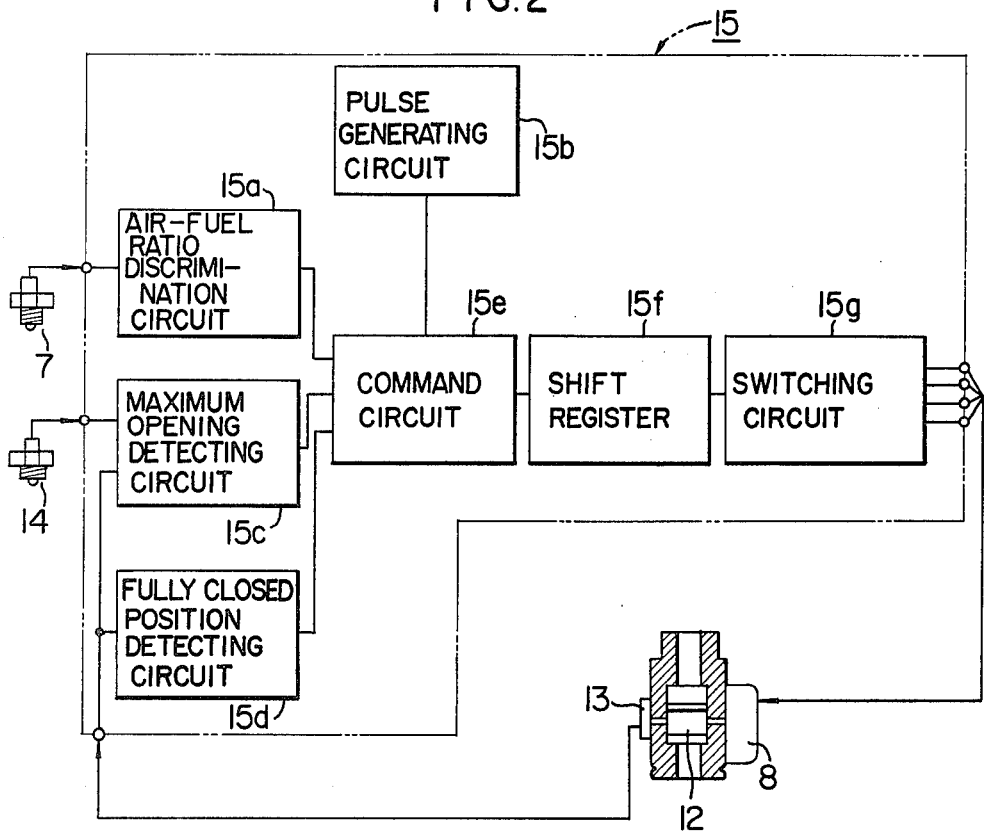
FIG. 2 is a block diagram of the control unit shown in FIG. 1.
Figure 3:
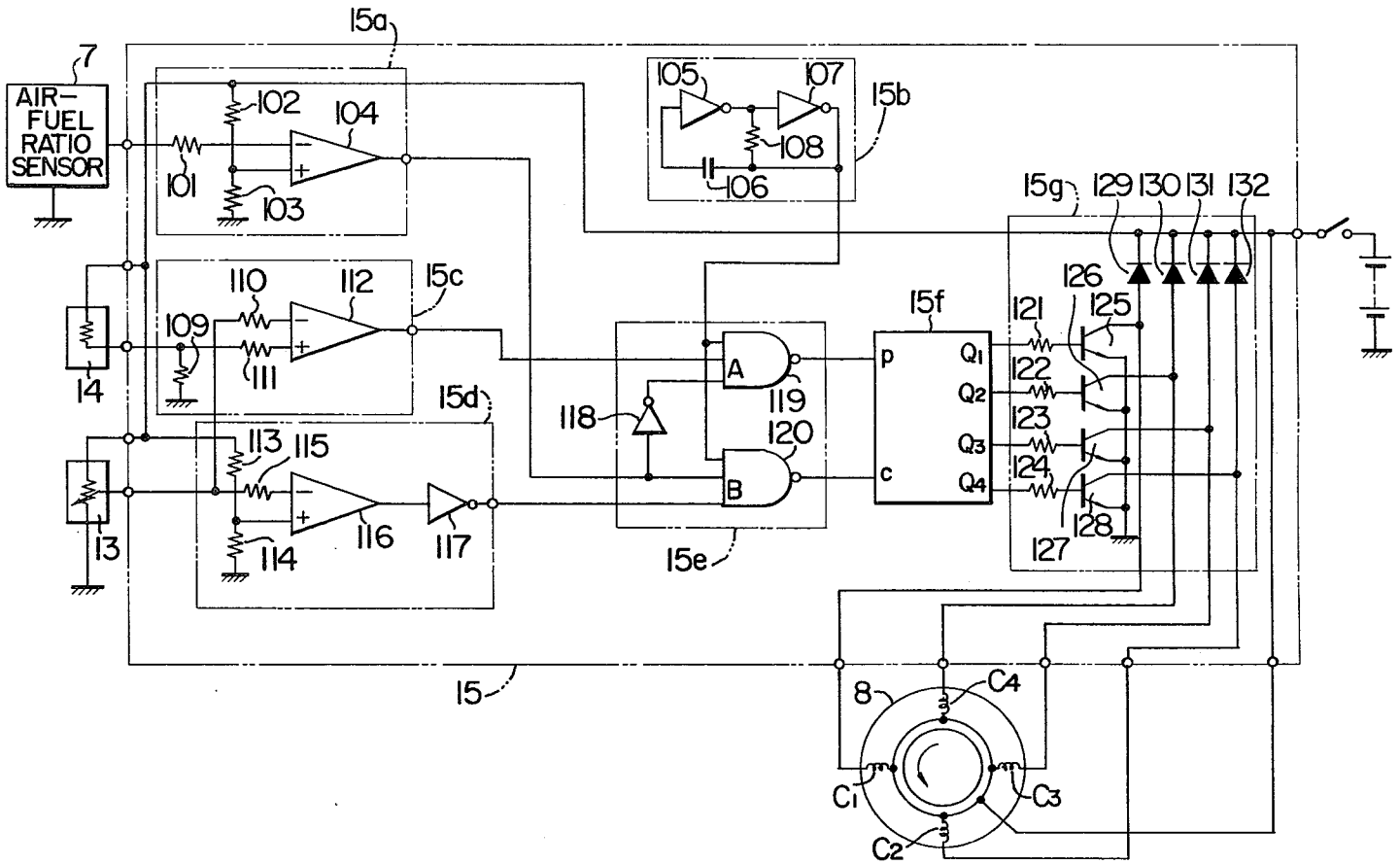
FIG. 3 is a circuit diagram of the control unit shown in FIG. 2.

FIGS. 2 and 3 are respectively a block diagram and a circuit diagram showing the control unit 15. The control unit 15 comprises an air-fuel ratio discrimination circuit **15*a* for determining the relative magnitude of the air-fuel ratio of the mixture, a pulse generating circuit 15*b* for producing pulses of a predetermined frequency, a maximum opening detecting circuit 15*c* for detecting the maximum opening of the bypass valve 12, a fully closed position detecting circuit 15*d* for detecting that the bypass valve 12 is in its fully closed position, a command circuit 15*e* for performing logical operations on the signals from the circuits 15*a* to 15*d*, a reversible shift register 15*f* whose output is shifted in accordance with the output of the command circuit 15*e*, and a switching circuit 15*g* for performing a switching operation in accordance with the shifting of the output of the reversible shift register 15*f***.

With the construction described above, the operation of the first embodiment will now be described with reference to the circuit diagram of FIG. 3. The carburetor 1 is of the type which performs the ordinary function of metering fuel, and it is in no way different from the known type of carburetor except that it has been adjusted to produce a mixture which is slightly rich in fuel or a mixture with an air-fuel ratio which is slightly small as compared with the desired air-fuel ratio to be controlled, and the normal main air is mixed with the corresponding amount of fuel and supplied to the engine 3 through the carburetor 1. After the completion of the combustion in the engine 3, the exhaust gases are discharged to the atmosphere through the exhaust manifold 5 and the three-way catalytic converter 6, and at this time the air-fuel ratio of the mixture is detected by the air-fuel ratio sensor 7 mounted in a portion of the exhaust passage of the exhaust manifold 5. The output signal of the air-fuel ratio sensor 7 is applied to the control unit 15 which in turn determines whether the detected air-fuel ratio is smaller or greater than the stoichiometric air-fuel ratio, whereby when the detected air-fuel ratio is determined small as compared with the stoichiometric one, the pulse motor 8 operates the bypass valve 12 mounted in the additional air passage 11 in a direction which opens it, whereas when the detected air-fuel ratio is determined great, the bypass valve 12 is operated in a direction which closes it, thereby compensating the air-fuel ratio of the mixture by means of additional air to control it at the stoichiometric air-fuel ratio. The output signal of the air-fuel ratio sensor 7 is applied to the air-fuel ratio discrimination circuit 15*a* comprising resistors 101, 102 and 103 and a differential operational amplifier 104 (hereinafter referred to as OP AMP), whereby the input signal is compared with a preset voltage determined by the resistors 102 and 103 (i.e., the voltage equal to the electromotive force produced by the air-fuel ratio sensor 7 at around the stoichiometric air-fuel ratio) so that when the input signal is higher than the preset voltage or when the detected air-fuel ratio is smaller than the stoichiometric one, the output of the OP AMP 104 goes to a "0" level, whereas when the input voltage is lower than the preset voltage or when the detected air-fuel ratio is greater than the stoichiometric one, the output of the OP AMP 104 goes to a "1" level. The pulse generating circuit 15*b* comprises NOT gates 105 and 107, a capacitor 106 and a resistor 108 forming an astable multivibrator, and the frequency of its output pulses is selected to ensure the optimum control. The potentiometer 13 is operatively associated with the bypass valve 12 to detect its opening, and a voltage is applied across the potentiometer 13, whereby the movable contact of the potentiometer 13 is moved in response to the rotation of the bypass valve 12 to change the resistance value between the movable contact and the ground and convert this change into a voltage variation, and the resulting output signal is applied to the maximum opening detecting circuit 15*c* and the fully closed position detecting circuit 15*d*. The output of the warm-up sensor 14 which detects the warming conditions of the engine 3, is also applied to the maximum opening detecting circuit 15*c*.

The maximum opening detecting circuit 15*c* comprises resistors 109, 110 and 111 and an OP AMP 112, and the fully closed position detecting circuit 15*d* comprises resistors 113, 114 and 115, an OP AMP 116 and a NOT gate 117. Each of these circuits constitutes a voltage comparator circuit. In the maximum opening detecting circuit 15*c*, the output voltage of the potentiometer 13 is compared with the voltage determined by the warm-up sensor 14 and the resistor 109 to produce an output signal, and the fully closed position detecting circuit 15*d* compares the output voltage of the potentiometer 13 with the preset voltage determined by the resistors 113 and 114 to produce an output signal. When the bypass valve 12 is in the fully closed position, only the output of the fully closed position detecting circuit 15*d* goes to the "0" level, whereas when the bypass valve 12 is in the maximum position only the output of the maximum opening detecting circuit 15*c* goes to the "0" level, and the outputs of these circuits both go to the "1" level when the bypass valve 12 is in any other position.

The control characteristic of the maximum opening detecting circuit 15*c* for controlling the opening of the bypass valve 12 in relation to the cooling water temperature, will now be described with reference to FIG. 4. When the temperature (cooling water temperature) of the engine 3 is low, the resistance value of the thermistor in the warm-up sensor 14 is high so that the voltage level at the dividing point of the warm-up sensor 14 and the resistor 109 is low, and as the engine 3 gradually warms up the resistance value of the thermistor decreases, thus causing the voltage level to rise. In the potentiometer 13 for detecting the opening of the bypass valve 12, the resistance between the movable contact and the ground is low when the bypass valve 12 is in the fully closed position, and this resistance increases as the bypass valve 12 is opened. As a result, the output voltage level of the potentiometer 13 is lowest when the bypass valve 12 is in the fully closed position, and the voltage level is highest when the bypass valve is in the fully opened position. Consequently, the resulting output voltages are compared with one another by the OP AMP 112, so that the maximum opening of the bypass valve 12 is increased as the cooling water temperature increases or as the engine warms up as shown by the solid line *a* in FIG. 4. The output of the OP AMP 112 goes to the "1" level in the range to the right of the solid line *a* in FIG. 4, and it goes to the "0" level in the range to the left of the solid line *a*. Also, the characteristic shown by the solid line *a* may be set as desired in accordance with the characteristic of the cooling water temperature sensor, the shape of the bypass valve 12, the characteristic of the potentiometer 13, etc., and it should preferably be set to suit the warm-up operating characteristic of the engine 3.

The output signal of the air fuel ratio discrimination circuit 15*a*, the output signals of the maximum opening detecting circuit 15*c* and the fully closed position detecting circuit 15*d* and the pulse signals from the pulse generating circuit 15*b* are applied to the command circuit 15*e* which in turn produces the required forward, reverse and stop signals for the pulse motor 8. The command circuit 15*e* comprises a NOT gate 118 and NAND gates 119 and 120 constituting a control logic circuit. When the mixture is on the rich side, the NAND 119 is opened and consequently the pulse signals produced from the pulse generating circuit 15*b* are applied to an input terminal P of the reversible shift register 15*f*, whereas when the mixture is on the lean side, the similar pulse signals are applied to an input terminal C of the reversible shift register 15*f*. When the pulse signals are applied to the input terminal P of the shift register 15*f*, its output terminals $Q_1$, $Q_2$, $Q_3$ and $Q_4$ are sequentially shifted. On the contrary, when the pulse signals are applied to the input terminal C, the output terminals $Q_4$, $Q_3$, $Q_2$ and $Q_1$ are sequentially shifted in this order. The output terminals $Q_1$, $Q_2$, $Q_3$ and $Q_4$ are connected to the switching circuit 15*g* comprising resistors 121, 122, 123 and 124, transistors 125, 126, 127 and 128, and back electromotive force absorbing diodes 129, 130, 131 and 132, and the switching circuit 15*g* is in turn connected to field coils $C_1$, $C_2$, $C_3$ and $C_4$ of the pulse motor 8.

Thus, when the pulse signals are applied to the input terminal P of the reversible shift register 15*f*, the transistors 125, 126, 127 and 128 are sequentially turned on, and the field coils $C_1$, $C_2$, $C_3$ and $C_4$ of the pulse motor 8 are similarly energized two phases at a time, rotating the rotor of the pulse motor 8 in the direction of the arrow in FIG. 3. In other words, when the air-fuel ratio of the mixture is small, the bypass valve 12 is rotated in a direction which opens it. When the pulse signals are applied to the input terminal C, the reverse takes place so that the pulse motor 8 is rotated in a direction opposite to the direction of the arrow in FIG. 3, and the bypass valve 12 is rotated in a direction which closes it. During this operation, in order that the bypass valve 12 which has been moved to the fully closed position or the maximum opening position may be prevented from being rotated further to an "overshoot" position, when, for example, the potentiometer 13 detects that the bypass valve 12 is in the fully closed position, the fully closed position detecting circuit 15*d* closes the NAND gate 120 so that the supply of the pulse signals to the reversible shift register 15*f* is stopped, and the pulse motor 8 is prevented from rotating the bypass valve 12 in the closing direction. On the contrary, when the bypass valve 12 is in the maximum opening position which is controlled by the cooling water temperature or the engine conditions during the warm-up period, the the maximum opening position detecting circuit 15*c* closes the NAND gate 119, so that the supply of the pulse signals to the reversible shift register 15*f* is stopped and the pulse motor 8 is prevented from rotating the bypass valve 12 in the direction which opens it. In this way, the problem of making the normal operation impossible due to the "overshoot" condition of the bypass valve 12 is overcome.

The operation of the bypass valve 12 during the time that the engine 3 is at the warm-up operation and the cooling water temperature is, for example, at $T_2$ in FIG. 4, will now be described with reference to FIG. 5. Where the maximum opening of the bypass valve 12 is not controlled, the direction of rotation of the bypass valve 12 is reversed by the signal from the air-fuel ratio discrimination circuit 15*a* at the time of $t_1, t_2, \ldots, t_5, \ldots$, and consequently the air-fuel ratio of the mixture is kept at the stoichiometric air-fuel ratio, thus making it impossible to supply the required rich mixture for engine warm-up operation. On the contrary, in accordance with the present invention, when the cooling water temperature is at $T_2$, as will be seen from FIG. 4, the maximum opening of the bypass valve 12 is controlled at $S_2$ and the bypass valve 12 is opened and closed to any positions smaller than $S_2$. Namely, the opening of the bypass valve 12 is controlled as shown by the sloped line in FIG. 4. As a result, during the warm-up operation the required rich mixture is supplied, and moreover the maximum opening of the bypass valve 12 is increased as the engine 3 warms up, and the air-fuel ratio of the mixture is controlled to gradually attain the stoichiometric air-fuel ratio.

Since, in this way, a richer mixture than required for the normal operation is supplied during the engine warm-up operation thus ensuring efficient operation of the engine, and moreover since the mixture is gradually leaned out to attain the predetermined air-fuel ratio as the engine warms up, the CO and HC emissions are reduced and an improved exhaust emission control is ensured.

Figure 6:
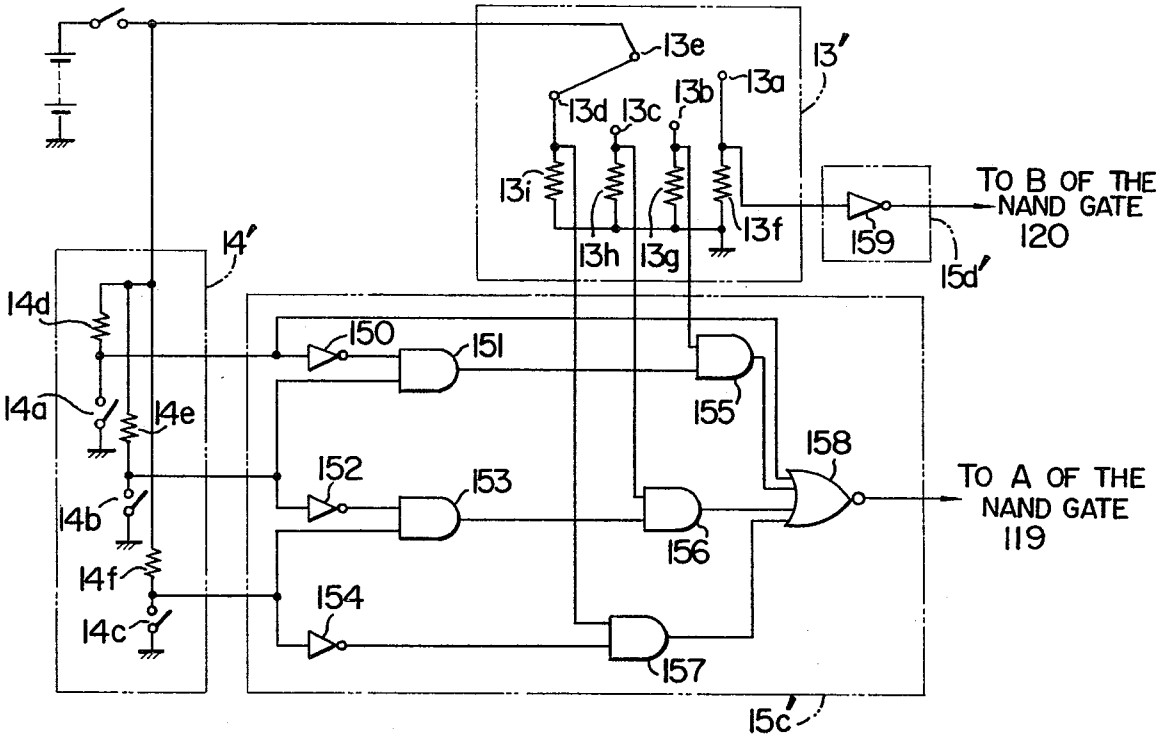
FIG. 6 is a circuit diagram showing the principal parts of a second embodiment of the invention.

FIG. 6 shows the principal parts of a second embodiment of the invention. While, in the first embodiment, the position sensor 13 comprises a potentiometer whose resistance value is varied continuously and the warm-up sensor 14 also comprises a thermistor whose resistance value is varied continuously, in the second embodiment a position sensor 13' comprises a switch type sensor for detecting the positions $S_0$, $S_1$, $S_2$ and $S_4$ of the bypass valve 12 shown in FIG. 4, and a warm-up sensor 14' comprises thermoswitches in which a reed switch is turned on and off in accordance with changes in the magnetic permeability of a thermoferrite.

In the Figure, the position sensor 13' comprises stationary contacts 13*a* to 13*d* which are arranged in the positions corresponding to the positions $S_0$ to $S_3$ of the bypass valve 12, a movable contact 13*e* connected to the power source and operatively coupled to the bypass valve 12, and resistors 13*f* to 13*i* having one ends respectively connected to the stationary contacts 13*a* to 13*d* and the other ends connected to the ground. The warm-up sensor 14' comprises thermoswitches 14*a*, 14*b* and 14*c* which respectively change their reed switches from the off to on position as the cooling water temperature exceeds the temperatures $T_1$, $T_2$ and $T_3$ shown in FIG. 4, and resistors 14*d* to 14*f* having one ends connected to the power source and the other ends respectively connected to the thermoswitches 14*a* to 14*c*.

A maximum opening detecting circuit 15*c'* comprises NOT gates 150, 152 and 154, AND gates 151, 153, 155, 156 and 157 and a NOR gate 158, and a fully closed position detecting circuit 15*d'* comprises a NOR gate 159. The output terminals of these circuits are respectively connected to an input terminal A of the NAND gate 119 and an input terminal B of the NAND gate 120 shown in FIG. 3. The remaining circuit construction is identical with the corresponding part of the embodiment shown in FIG. 3.

With the construction described above, when the bypass valve 12 is fully closed, the movable contact 13*e* comes into contact with the stationary contact 13*a*, so that the output of the NOT gate 159 or the fully closed position detecting circuit 15*d'* goes to the "0" level, and this "0" level signal is applied to the NAND gate 120 of the command circuit 15*e*, thus closing the NAND gate 120 and thereby preventing the bypass valve 12 from being rotated further in the closing direction.

Figure 4:
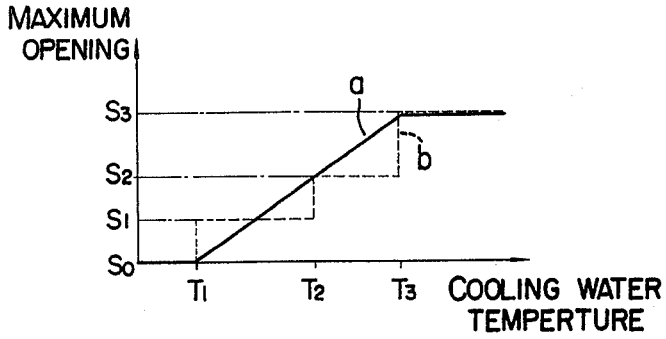
FIG. 4 is a characteristic diagram showing the relationship between the cooling water temperature and the maximum opening of the bypass valve.
Figure 5:
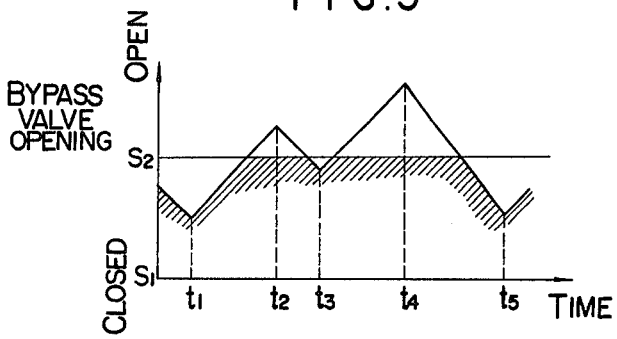
FIG. 5 is a characteristic diagram showing the operation of the bypass valve during engine warm-up periods.

When the cooling water temperature is lower than the temperature $T_1$ shown in FIG. 4, the thermoswitches 14*a*, 14*b* and 14*c* of the warm-up sensor 14' are all open so that the output of the NOR gate 158 (or the output of the maximum opening detecting circuit 15*c'*) goes to the "0" level, and the NAND gate 119 of the command circuit 15*e* is closed. As a result, the bypass valve 12 is prevented from being rotated in the opening direction, and the bypass valve 12 is held in the fully closed position as long as the cooling water temperature is below $T_1$.

As the engine 3 starts warming up so that the cooling water temperature becomes higher than $T_1$ but lower than $T_2$ in FIG. 4, the thermoswitch 14*a* is closed and the output of the AND gate 151 goes to the "1" level. Simultaneously, the output of the NOR gate 158 goes to the "1" level, and this "1" level signal is applied to the NAND gate 119 of the command circuit 15*e*. When the air-fuel ratio discrimination circuit 15*a* determines that the air-fuel ratio of the mixture is small thus producing a "0" level signal, this "0" level signal is inverted to a "1" level signal and applied to the NAND gate 119 through the NOT gate 118. Consequently, the NAND gate 119 is opened, and the pulse signals from the pulse generating circuit 15*b* are applied to the shift register 15*f* through the NAND gate 119, thus rotating the bypass valve 12 in the direction which opens it.

When the bypass valve 12 is rotated in the opening direction so that it is eventually moved to the position $S_1$ in FIG. 4, the movable contact 13*e* comes into contact with the stationary contact 13*b*, and the output of the NAND gate 155 of the maximum opening detecting circuit 15*c'* goes to the "1" level, thereby causing the output of the NOR gate 158 to change from the "1" level to the "0" level. This "0" level signal from the NOR gate 158 is applied to the NAND gate 119 so that the NAND gate 119 is closed, and the bypass valve 12 is stopped rotating further in the direction which opens it.

In this way, the maximum opening of the bypass valve 12 is set to the position $S_1$ when the cooling water temperature is above $T_1$ but below $T_2$.

Similarly, when the cooling water temperature becomes higher than $T_2$ but lower than $T_3$, the maximum opening of the bypass valve 12 is controlled at the position $S_2$ which is set by the stationary contact 13*c*, and when the cooling water temperature exceeds $T_3$, the maximum opening of the bypass valve 12 is controlled at the position $S_3$ which is set by the stationary contact 13*d*. Thus, the relationship between the cooling water temperature and the maximum opening of the bypass valve 12 takes a stepped form as shown by the dotted line in FIG. 4. The remaining construction and operation of this embodiment will not be described, since they are the same with those of the first embodiment shown in FIG. 3.

With this invention, it is of course possible to use the above-mentioned switch type sensors in combination with the continuously variable resistance type sensors of the first embodiment. Further, while, in the above-described embodiments, the driving means comprises a pulse motor, the similar effects may be obtained by means of a mechanical bypass valve which is operated by controlling the pressure, e.g., the vacuum by means of a diaphragm, and this device may also be applied to the additional air supply system. Further, the air-fuel ratio sensor is not intended to be limited to one employing zirconium dioxide as the principal element, and any other metal oxide such as titanium dioxide ($TiO_2$) may also be employed.

While, in the above-described first and second embodiments of the invention, the maximum opening of the bypass valve 12 is set in accordance with the engine temperature (cooling water temperature), in the third embodiment of the invention which will be described hereinafter, the maximum opening of the bypass valve is set in accordance with the amount of air drawn into the engine, particularly the opening of the throttle valve. The system of this embodiment is identical with that shown in FIG. 1 except that the warm-up sensor 14 is replaced with a throttle position sensor 214 shown by the dotted line in FIG. 1 and designed to detect the opening of the throttle valve 10.

Figure 7:
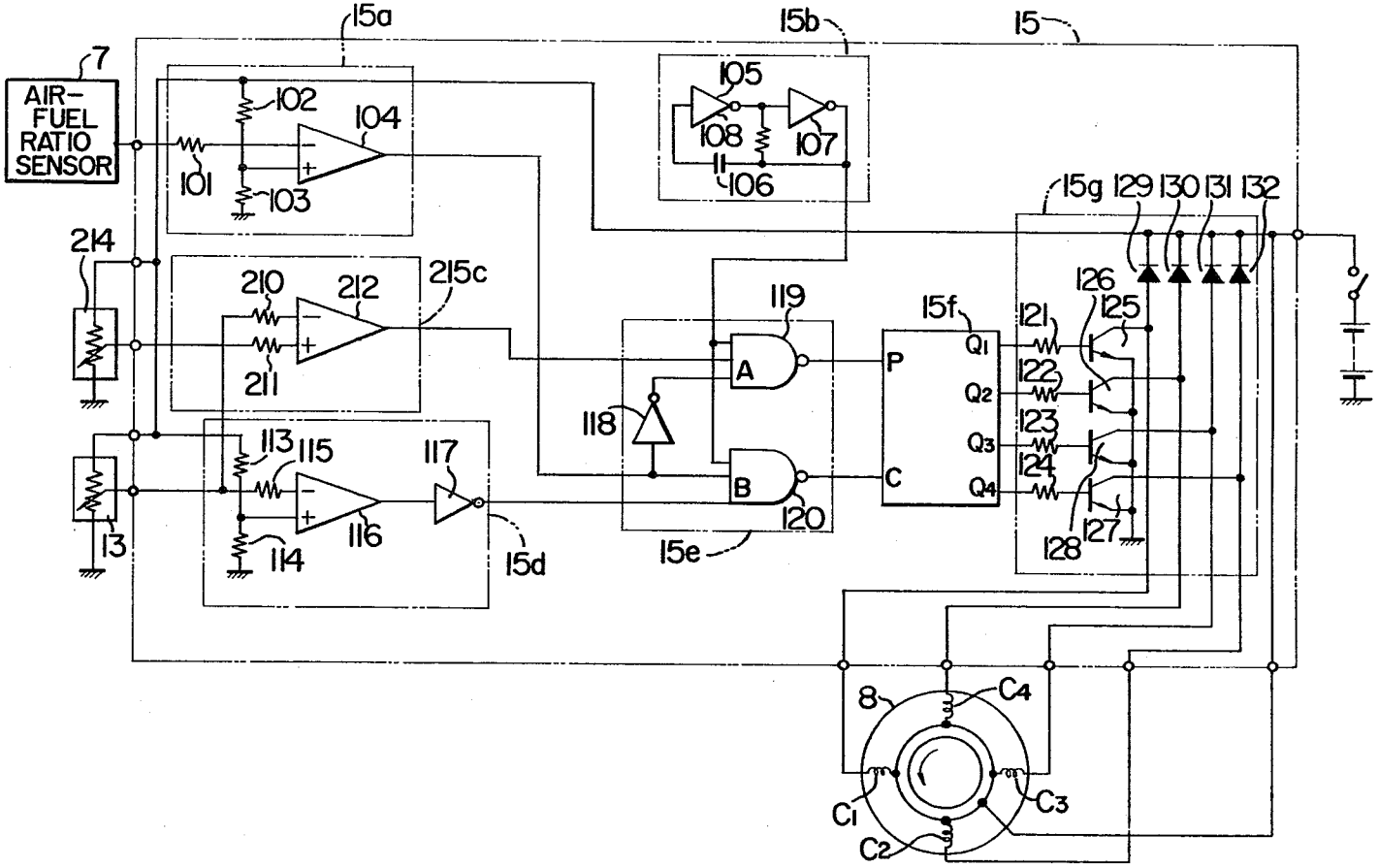
FIG. 7 is a circuit diagram showing a third embodiment of the invention.

The detailed circuit of the control unit 15 of this embodiment is shown in FIG. 7. The throttle position sensor 214 comprises a potentiometer across which is applied a voltage and a movable contact movable in response to the movement of the throttle valve 10, whereby in response to the throttle valve 10 the resistance value between the movable contact and the ground is changed and converted into a voltage variation, and the resulting output signal is applied to a maximum opening detecting circuit 215*c*.

The maximum opening detecting circuit 215*c* comprises resistors 210 and 211 and an OP AMP 212, and the OP AMP 212 receives at its noninverting input terminal the output of the throttle position sensor 214 and at its inverting input terminal the signal from the potentiometer 13 which detects the opening of the bypass valve 12. The OP AMP 212 compares its two input signals and produces a "0" level signal when the bypass valve 12 is in the maximum opening position in the same manner as described in connection with the first embodiment shown in FIG. 3. The remaining construction and operation of this embodiment will not be described in detail, since they are the same with those of the first embodiment shown in FIG. 3.

The relationship between the maximum opening of the bypass valve 12 determined by the maximum opening detecting circuit 215*c* and the throttle opening will now be described with reference to FIG. 8. If it is so set that the resistance value between the ground and the movable contact of the potentiometers 13 and 214, respectively, is increased with increase in the opening of the throttle valve 10 and the bypass valve 12, respectively, the output voltage level of the throttle position sensor 214 is low when the opening of the throttle valve 10 is at around the fully closed position, and this output voltage level increases as the throttle valve 10 is opened from the fully closed position. Similarly, the output voltage level of the potentiometer 13 is lowest when the bypass valve 12 is in the fully closed position, and the output voltage level reaches its maximum when the bypass valve 12 is in the fully opened position. These output voltages are compared by the OP AMP 212, with the result that the maximum opening of the bypass valve 12 is increased with increase in the throttle opening or the amount of intake air as shown by the solid line *a* in FIG. 8. The output of the OP AMP 212 goes to the "1" level in the range to the right of the solid line *a* in FIG. 8, and it goes to the "0" level in the range to the left of the solid line *a*. The characteristic shown by the solid line *a* may for example be set as desired in accordance with the characteristic of the throttle position sensing potentiometer 214, the shape of the bypass valve 12 and the characteristic of the potentiometer 13, this characteristic should preferably be set to suit the operating characteristics of the engine 3.

The operation of the bypass valve 12 with the opening of the throttle valve 10 held between $Q_1$ and $Q_2$ shown in FIG. 8, will now be described with reference to FIG. 9. Where the maximum opening of the bypass valve 12 is not controlled, the direction of rotation of the bypas valve 12 is reversed at the time of $t_1$, $t_2$, . . . $t_5$, . . . by the signal from the air-fuel ratio discrimination circuit 15*a*, with the result that the maximum opening of the bypass valve 12 inevitably becomes greater than $S_2$, and the mixture becomes excessively lean during low speed and load operation of the engine, thus failing to supply the required mixture. On the contrary, in accordance with the present invention, when the opening of the throttle valve 10 is between $\theta_1$ and $\theta_2$, the maximum opening of the bypass valve 12 is set to $S_2$ as shown in FIG. 8, and the movement of the bypass valve 12 is limited to any opening smaller than $S_2$. Consequently, during the low speed and load operation of the engine, the amount of additional air is decreased and the desired mixture is supplied to the engine 3, thereby preventing the occurrence of such phenomena as backfiring and engine stalling.

Figure 8:
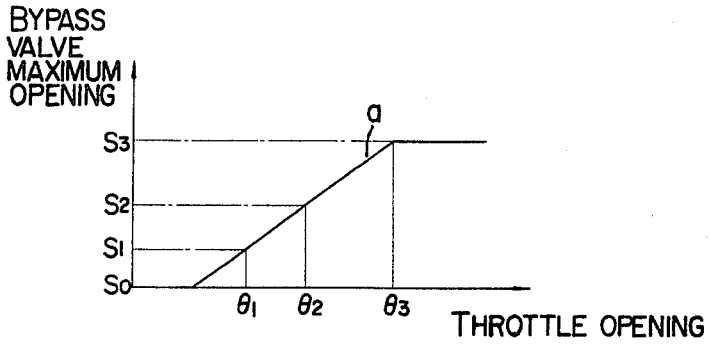
FIG. 8 is a characteristic diagram showing the relationship between the throttle opening and the maximum opening of the bypass valve in the third embodiment.
Figure 9:
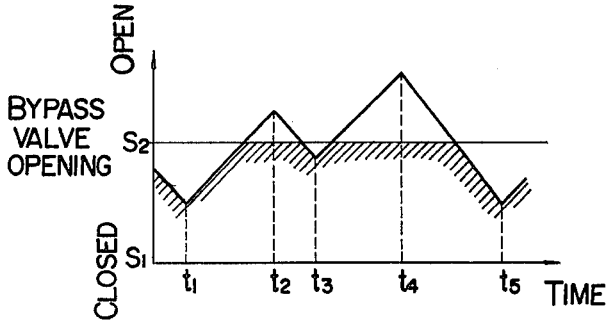
FIG. 9 is a characteristic diagram showing the operation of the bypass valve.

On the other hand, when the opening of the throttle valve 10 is increased for example to $\theta_3$ in FIG. 8 so that the engine 3 comes into the high speed and load operation, the setting of the maximum opening of the bypass valve 12 is increased to $S_3$ as shown in FIG. 8, with the result that the amount of additional air is adjusted to suit the high speed and load operation of the engine 3, and the air-fuel ratio of the mixture is properly controlled at the desired air-fuel ratio.

Figure 10:
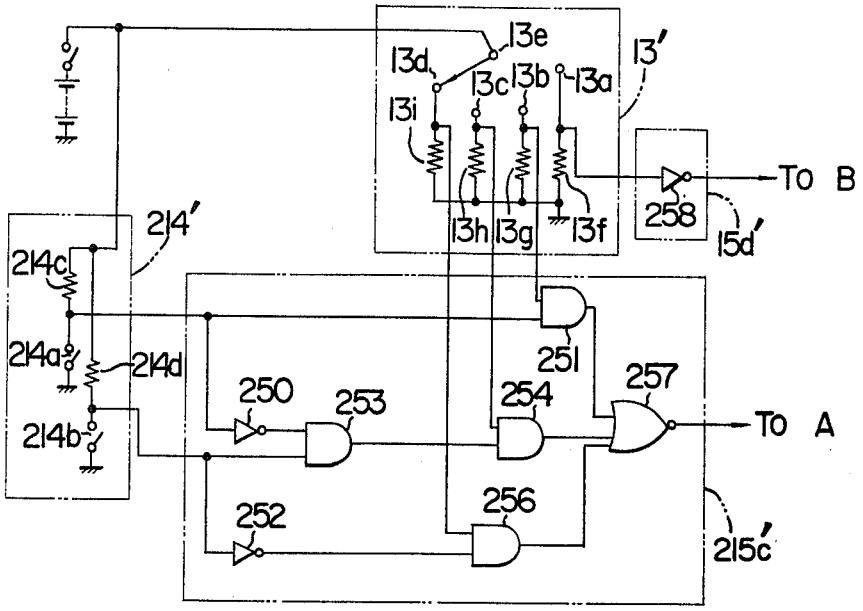
FIG. 10 is a circuit diagram showing the principal parts of a fourth embodiment of the invention.

FIG. 10 shows the principal parts of a fourth embodiment of the invention which differs from the third embodiment in that while, in the third embodiment, the bypass valve position sensor 13 comprises a potentiometer whose resistance value is varied continuously and the throttle position sensor 214 for detecting the throttle opening or a parameter proportional to the amount of intake air also comprises a potentiometer whose resistance value is varied continuously, in this fourth embodiment a bypass valve position sensor 13' comprises a switch type sensor for detecting the positions $S_0$, $S_1$, $S_2$ and $S_3$ of the bypass valve 12 shown in FIG. 8, and an intake air flow sensor 214' comprises a negative pressure sensor in which a switch is opened and closed in accordance with the intake manifold vacuum or a parameter related to the intake air flow.

In the Figure, the bypass valve position sensor 13' comprises stationary contacts **13*a* to 13*d* arranged to respectively set the positions $S_0$ to $S_3$ of the bypass valve 12, a movable contact 13*e* connected to the power source and operatively associated with the bypass valve 12, and resistors 13*f* to 13*i* having one ends connected respectively to the stationary contacts 13*a* to 13*d* and the other ends connected to the ground. The negative pressure sensor or intake air flow sensor 214' comprises negative pressure switches 214*a* and 214*b* of the known type whose contacts are opened and closed in response to negative pressures $P_1$ and $P_2$, respectively, shown in FIG. 11, and resistors 214*c* and 214*d* having one ends connected to the power source and the other ends respectively connected to the negative pressure switches 214*a* and 214*b***.

A maximum opening detecting circuit **215*c'* comprises NOT gates 250 and 252, AND gates 251, 253, 254 and 256 and a NOR gate 257, and the fully closed position detecting circuit 15*d'* comprises a NOT gate 258. The output terminals of these circuits are respectively connected to the input terminal A of the NAND gate 119 and the input terminal B of the NAND gate 120 shown in FIG. 7**.

With the construction described above, the fourth embodiment operates as follows. When the bypass valve 12 is fully closed, the movable contact **13*e* comes into contact with the stationary contact 13*a*, so that the output of the NOT gate 258 or the fully closed position detecting circuit 15*d'* goes to the "0" level, and this "0" level signal is applied to the NAND gate 120 of the command circuit 15*e*, thus closing the NAND gate 120 and thereby preventing the bypass valve 12** from being rotated in the direction which closes it.

Figure 11:
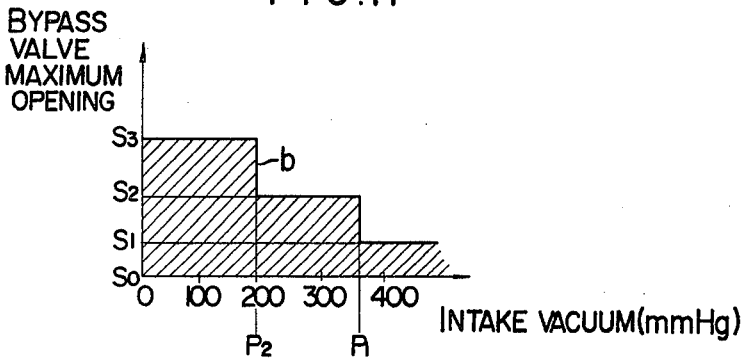
FIG. 11 is a characteristic diagram showing the relationship between the intake vacuum and the maximum opening of the bypass valve in the fourth embodiment.

When the intake manifold vacuum exceeds the negative pressure $P_1$ shown in FIG. 11, namely, when the absolute pressure is low and the flow of intake air is small, the negative pressure switches **214*a* and 214*b* of the intake air flow sensor 214' are both open, so that the outputs of the AND gates 254 and 256 go to the "0" level, and a "1" level signal is applied to one input terminal of the AND gate 251**.

When the bypass valve 12 is moved to the fully closed position as mentioned previously, a "0" level signal is applied to the other input of the AND gate 251, so that the output of the AND gate 251 goes to the "0" level, and the output of the NOR gate 257 goes to the "1" level. This "1" level signal is applied to the NAND gate 119 of the command circuit **15*e*, so that when the air-fuel ratio discrimination circuit 15*a* detects that the air-fuel ratio of the mixture is small and produces a "0" level signal, this "0" level signal is inverted to a "1" level signal and applied to the NAND gate 119 through the NOT gate 118, and the NAND gate 119 is opened. Consequently, the pulse signals from the pulse generating circuit 15*b* are applied to the shift register 15*f* by way of the NAND gate 119, and the bypass valve 12** is rotated in the direction which opens it.

When the bypass valve 12 is rotated in the opening direction so that it is eventually opened to the position $S_1$ shown in FIG. 11, the movable contact **13*e* comes into contact with the stationary contact 13*b*, and a "1" level signal is applied to the AND gate 251. At this time, the output of the NOR gate 257 in the maximum opening detecting circuit 215*c'* changes from the "1" level to the "0" level, and the NAND gate 119 is closed, thereby preventing the bypass valve 12 from being rotated further in the direction which opens it. In this way, the maximum opening of the bypass valve 12** is set to $S_1$ when the intake manifold pressure is greater than $P_1$.

Similarly, when the intake manifold vacuum is between $P_1$ and $P_2$, the maximum opening of the bypass valve 12 is controlled at the position $S_2$ which is set by the stationary contact **13*c*, whereas when the intake manifold vacuum is less than $P_2$, the maximum opening of the bypass valve 12 is controlled at the position $S_3$ which is set by the stationary contact 13*d*. Thus, the relationship between the intake manifold vacuum and the maximum opening of the bypass valve 12** takes a stepped form as shown by the solid line *b* in FIG. 11. The remaining construction and operation will not be described, since they are the same with those shown and described in connection with FIG. 3.

While, in the embodiments described above, the throttle opening or the intake manifold vacuum is employed as a parameter related to the flow of intake air, the similar effects may be obtained by employing any other engine parameter, such as, engine rpm or venturi vacuum which is related to the intake air flow as well as a transmission position or vehicle speed in the case of automobile engines.

Further, while, in these embodiments, the driving means comprises a pulse motor, the similar effects may be obtained by using a mechanical bypass valve in which the bypass valve is operated by controlling the pressure, e.g., the negative pressure by a diaphragm, and this means is also applicable to the additional air supply system.

Next, a fifth embodiment of the invention will be described. The system of this embodiment is the same with the embodiment shown in FIG. 1, and the maximum opening of the bypass valve 12 is suitably set in accordance with the signals from a warm-up sensor 14 and a throttle position sensor 214.

The detailed circuit and operation of this fifth embodiment will be described with reference to FIGS. 12 and 13. As in the case of the first embodiment, the output signal of the air-fuel ratio sensor 7 is applied to an air-fuel ratio discrimination circuit **15*a* in the control unit 15, and then the signal is compared with the preset voltage determined by its resistors 102 and 103 (the voltage equal to the electromotive force produced by the air-fuel ratio sensor 7 at around the stoichiometric air-fuel ratio) in such a manner that when the input voltage is higher than the preset voltage or when the detected air-fuel ratio is smaller than the stoichiometric one, its output goes to the "0" level, whereas when the input voltage is lower than the preset voltage or the detected air-fuel ratio is greater than the stoichiometric one, the output goes to the "1" level. A pulse generating circuit 15***b* comprises NOT gates 105 and 107, a capacitor 106 and a resistor 108 constituting an astable multivibrator, and its output pulse frequency is selected to ensure the optimum control.

A bypass valve position sensor 13 for detecting the opening of the bypass valve 12 comprises stationary contacts 13*a* to 13*d* which are arranged in positions $S_0$ to $S_3$ corresponding to the various positions of the bypass valve 12 (i.e., $S_0$ is the fully closed position, and $S_3$ is the fully opened position), a movable contact 13*e* operatively associated with the bypass valve 12 and connected to the power source, and resistors 13*f* to 13*i* having one ends respectively connected to the stationary contacts 13*a* to 13*d* and the other ends connected to the ground, and a "1" level signal is produced when the movable contact 13*e* comes into contact with the stationary contacts 13*a* to 13*d* respectively.

A warm-up sensor 14 comprises thermoswitches 14*a* and 14*b* of the known type in which the reed relay is turned on and off by virtue of the temperature-magnetic permeability characteristic of a thermoferrite, and resistors 14*c* and 14*d* having one ends respectively connected to the thermoswitches 14*a* and 14*b* and the other ends connected to the power source. The thermoswitches 14*a* and 14*b* are disposed in the cooling water passage of the engine 3 and are so set that the thermoswitch 14*a* is turned on when the cooling water temperature exceeds $T_1$ and the thermoswitch 14*b* is turned on when the cooling water temperature exceeds $T_2$. A "1" level signal is produced when the thermoswitches are off.

A throttle position sensor 214 for detecting the opening of the throttle valve 10, is substantially the same in construction with the bypass valve position sensor 13, and it comprises stationary contacts 215*a* to 215*c* arranged in the positions 0 to $\theta_1$, $\theta_1$ to $\theta_2$ and $\theta_2$ to $\theta_3$ respectively corresponding to the various openings of the throttle valve 10, a movable contact 215*d* operatively associated with the throttle valve 10 and connected to the power source, and resistors 215*e* to 215*g* having one ends respectively connected to the stationary contacts 215*a* to 215*c* and the other ends connected to the ground, whereby a "1" level signal is produced when the movable contact 215*d* comes into contact with the stationary contacts 215*a* to 215*c*, respectively.

The stationary contacts 13*a* and 13*d* of the bypass valve position sensor 13 which respectively correspond to the fully closed position and the fully open position, are connected to a command circuit 15*e*, and the other stationary contacts 13*b* and 13*c* as well as the stationary contact 13*a* are connected to a maximum opening detecting circuit 15*c*. The warm-up sensor 14 and the throttle position sensor 214 are also connected to the maximum opening detecting circuit 15*c*.

The maximum opening detecting circuit 15*c* comprises AND gates 309, 310, 311, 314, 315, 317 and 318, NOT gates 312 and 313 and an OR gate 319, and it constitutes a control logic for determining the optimum maximum opening.

The output signal of the air-fuel ratio discrimination circuit 15*a*, the output signal of the maximum opening detecting circuit 15*c* and the pulse signals from the pulse signal generating circuit 15*b* are applied to the command circuit 15*e* which in turn produces the necessary forward, reverse and stop signals for the pulse motor 8. The command circuit 13*e* comprises a NOT gate 118 and OR gates 320 and 321 and constitutes a control logic.

In operation, when the mixture is on the rich side, the OR gate 320 is opened, and the pulse signals from the pulse generating circuit 15*b* are applied to an input terminal P of a reversible shift register 15*f*, whereas when the mixture is on the lean side the similar pulse signals are applied to an input terminal C of the reversible shift register 15*f*. When the pulse signals are applied to the input terminal P of the reversible shift register 15*f*, its output terminals $Q_1$, $Q_2$, $Q_3$ and $Q_4$ are sequentially shifted in this order. On the contrary, when the pulse signals are applied to the input terminal C, the output terminals $Q_4$, $Q_3$, $Q_2$ and $Q_1$ are sequentially shifted in this order. The output terminals $Q_1$, $Q_2$, $Q_3$ and $Q_4$ are connected to a switching circuit 15*g* comprising resistors 121, 122, 123 and 124, transistors 125, 126, 127 and 128 and back electromotive force absorbing diodes 129, 130, 131 and 132, and this switching circuit 15*g* is in turn connected to field coils $C_1$, $C_2$, $C_3$ and $C_4$ of the pulse motor 8.

Figure 12:
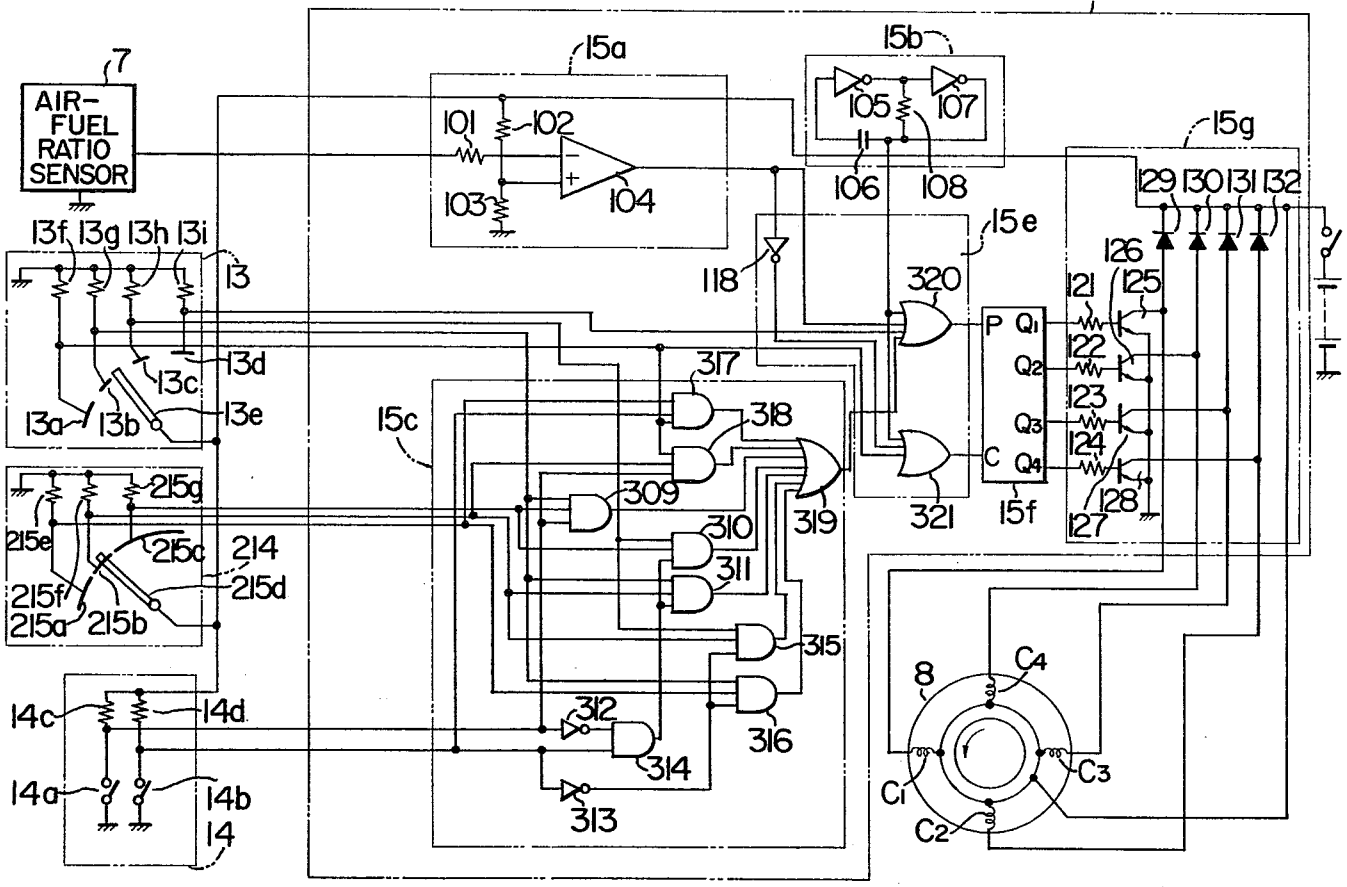
FIG. 12 is a circuit diagram showing a fifth embodiment of the invention.

Consequently, when the pulse signals are applied to the input terminal P of the reversible shift register 15*f*, the transistors 125, 126, 127 and 128 are sequentially turned on, and the field coils $C_1$, $C_2$, $C_3$ and $C_4$ of the pulse motor 8 are similarly energized two phases at a time, thus rotating the rotor of the pulse motor 8 in the direction of the arrow in FIG. 12. In other words, when the air-fuel ratio of the mixture is smaller, the bypass valve 12 is rotated in a direction which opens it. On the contrary, when the pulse signals are applied to the input terminal C, the rotor of the pulse motor 8 is rotated in a direction opposite to the direction of the arrow in FIG. 12, and the bypass valve 12 is rotated in a direction which closes it. During this operation, in order that in the event of the mixture failing to attain the desired air-fuel ratio when the bypass valve 12 is in the fully closed position or the maximum opening position, the air-fuel ratio discrimination circuit 15*a* may be prevented from rotating the bypass valve 12 further and moving it to an "overshoot" position, when the bypass valve position sensor 13 detects the fully closed positions $S_0$ of the bypass valve 12, for example, the movable contact 13*e* comes into contact with the stationary contact 13*a* so that the OR gate 321 is closed, and the supply of the pulse signals to the reversible shift register 15*f* is stopped, thus stopping the rotation of the pulse motor 8 in the direction which closes the bypass valve 12. On the contrary, when the bypass valve 12 is in the fully open position or in the maximum opening position that will be described later, the maximum opening detecting circuit 15*c* closes the OR gate 320, and the supply of the pulse signals to the reversible shift register 15*f* is stopped, thereby stopping the rotation of the pulse motor 8 in the direction which opens the bypass valve 12. In this way, the problem of rendering the normal operation of the bypass valve 12 impossible due to its "overshooting" is overcome. In the maximum opening detecting circuit 15*c* which determines the maximum opening of the bypass valve 12, the output of the OR gate 319 may be expressed through the use of Boolean algebra, as follows:

$$\theta_1 \cdot T_2 \cdot S_0 + \theta_1 \cdot T_2 \cdot S_1 + \theta_2 \cdot T_1 \cdot S_0 + \theta_2 \cdot T_1 \cdot T_2 \cdot S_1 + \theta_2 \cdot T_2 \cdot S_2 + \theta_3 \cdot T_1 \cdot S_1 + \theta_3 \cdot T_1 \cdot T_2 \cdot S_2$$

Note that a "1" is produced when there exists a condition $\theta_i$ ($i = 1, 2, 3$), that a "0" is produced when the temperature is higher than $T_n$ ($n = 1, 2$), and that a "1" is produced when there is a condition $S_m$ ($m = 0, 1, 2$). As a result, when this output goes to the "1" level, the OR gate 320 is closed stopping the rotation by the pulse motor 8 of the bypass valve 12 in the direction which opens it.

Figure 13:
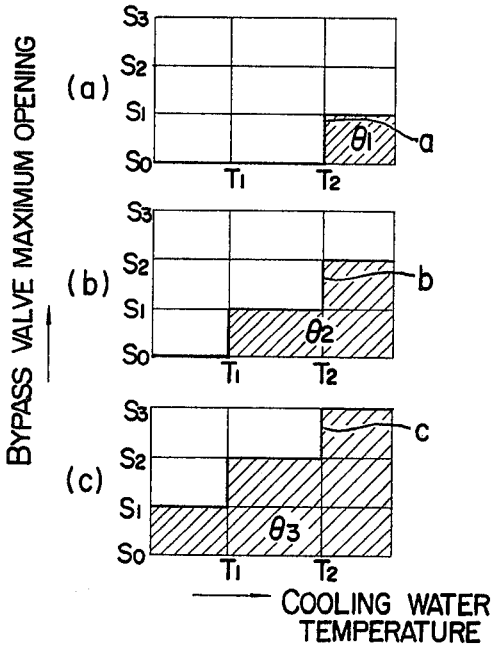
FIG. 13 is a characteristic diagram showing the relationship between the cooling water temperature and the maximum opening of the bypass valve in the fifth embodiment.

The above-mentioned logic expression is represented graphically in FIG. 13. In the Figure, (a) shows the case where the opening of the throttle valve 10 is between 0 (fully closed) and $\theta_1$, indicating that the bypass valve 12 is kept in the fully closed position (the position $S_0$) when the cooling water temperature is below $T_2$, and that when the cooling water temperature exceeds $T_2$ the maximum opening of the bypass valve 12 is set to $S_1$ so that the bypass valve 12 is opened and closed to any opening smaller than $S_1$ by the pulse motor 8 in accordance with the signal from the air-fuel ratio sensor 7. Shown by (b) of FIG. 13 is the case where the opening of the throttle valve 10 is between $\theta_1$ and $\theta_2$, indicating that the bypass valve 12 is kept in the fully closed position (the position $S_0$) when the cooling water temperature is below $T_1$, that the maximum opening of the bypass valve 12 is set to $S_1$ when the cooling water temperature is above $T_1$ but below $T_2$, and that the maximum opening is set to $S_2$ when the cooling water temperature is above $T_2$. Also shown by (c) of FIG. 13 is the case where the opening of the throttle valve 10 is between $\theta_2$ and $\theta_3$ ($\theta_3$ is the fully open position), indicating that similarly the maximum opening of the bypass valve 12 is set to $S_1$ when the cooling water temperature is below $T_1$, that the maximum opening is set to $S_2$ when the cooling water temperature is above $T_1$ but below $T_2$, and that the maximum opening is set to $S_3$ when the cooling water temperature is above $T_2$.

In this way, the maximum opening of the bypass valve 12 is increased as the cooling water temperature increases or as the engine 3 warms up and the opening of the throttle valve 10 increases, and consequently the maximum opening of the bypass valve 12 is progressively changed as shown by the solid lines *a, b* and *c* in FIG. 13. Thus, the operable range of the bypass valve 12 is shown by the hatched portions in FIG. 13.

Where the maximum opening of the bypass valve 12 is not controlled, the bypass valve 12 is operated throughout the range of openings including the fully closed and fully open positions thus controlling the air-fuel ratio of the mixture at the stoichiometric air-fuel ratio, while in accordance with the present invention the maximum opening of the bypass valve 12 is controlled at the openings smaller than the fully open position, thus controlling the mixture is to be kept richer than the stoichiometric air-fuel ratio.

As a result, a richer mixture than required for the normal operation is supplied during the engine warm-up operation thus ensuring efficient operation of the engine, and moreover as the engine warms up, the mixture is gradually leaned out to attain the preset air-fuel ratio, thus reducing CO and HC emissions and thereby ensuring efficient exhaust emission control.

Further, since the maximum opening of the bypass valve 12 is controlled in accordance with the opening of the throttle valve 10 or the amount of intake air, during periods of low speed and load operation there is no possibility of the additional air being supplied excessively through the additional air passage 11, thus preventing the mixture from becoming excessively lean and thereby preventing occurrence of such phenomena as backfiring and engine stalling. This also prevents a hunting phenomenon of the air-fuel ratio of the mixture due to such excessive supply of additional air, with the result that improved drivability is ensured, and the exhaust gas cleaning efficiency of the catalytic converter is also maintained high. Further, since the maximum opening of the bypass valve 12 is increased as the engine comes from the normal operation into the high speed and load operation, the mixture is prevented from becoming excessively rich but kept at the proper air-fuel ratio during the normal operation as well as the high speed and load operation.

While, in the embodiment described above, the throttle opening is utilized as an intake air flow parameter, it is possible to use the intake air flow itself as well as any other engine parameter having a functional relationship with the intake air flow, such as, engine rpm or venturi vacuum. In the case of automobile engines, the similar effects may be obtained by using the transmission position, vehicle speed or the like as a parameter.

Further, while, the warm-up sensor comprises a cooling water temperature sensor, the engine block temperature, engine ambient temperature or lubricating oil temperature may also be utilized. Also, a plurality of parameters may be used as inputs together. Further, while, in the above-described embodiment, the maximum opening of the bypass valve is controlled progressively, the maximum opening may be controlled continuously by means of potentiometers or voltage comparator circuits, or alternately the warming up conditions and intake air amounts may be properly weighted.

Further, while, in the above-described embodiment, the driving means comprises a pulse motor, the similar effects may be obtained by means of a mechanical bypass valve in which the bypass valve is operated by controlling the pressure, e.g., negative pressure with a diaphragm, and this is also applicable to the additional air supply system.

What we claim is:

1. In an air-fuel ratio adjusting system for an internal combustion engine including:

means communicated with an intake manifold of an internal combustion engine for producing and supplying to said engine air-fuel mixture;

a throttle valve disposed in said means for controlling the amount of said air-fuel mixture;

a bypass passage communicated with said intake manifold downstream of said throttle valve for supplying additional air therethrough;

a bypass valve operatively disposed in said bypass passage for controlling the opening area of said passage through which said additional air flows, whereby the amount of said additional air is controlled by said bypass valve;

an air-fuel ratio sensor disposed in an exhaust manifold of said engine for sensing the air-fuel ratio of the air-fuel mixture fed to said engine;

driving means operatively connected to said bypass valve for driving the same in a valve opening or closing direction; and a control unit electrically connected to said air-fuel ratio sensor and driving means for actuating said driving means in accordance with the output from said air-fuel ratio sensor in order to adjust the air-fuel ratio of the mixture to be fed to said engine, the improvement comprising:

a maximum opening detecting circuit electrically connected to said control unit for limiting a maximum opening of said bypass valve to a predetermined value depending on at least one of operating conditions of said engine, whereby effective operation for adjusting the air-fuel ratio can be obtained.

2. The improvement according to claim 1, wherein said maximum opening detecting circuit includes a temperature detecting device for detecting the temperature of said engine, so that the predetermined value for the maximum opening of said bypass valve increases as the temperature of said engine increases, whereby the total air-fuel ratio of the mixture to be fed to said engine is controlled as to be smaller than the stoichiometric one, thus ensuing the stable operation of said engine.

3. The improvement according to claim 1, further comprising a fully closed position sensor connected to said control unit for detecting said bypass valve at its fully closed position, so that when said bypass valve is at its fully closed position said control unit is stopped actuating said driving means in the valve closing direction.

4. The improvement according to claim 1, wherein said maximum opening detecting circuit includes a throttle position sensor for detecting the position of said throttle valve for increasing the predetermined value for the maximum opening of said bypass valve as the opening degree of said throttle valve is increased.

5. The improvement according to claim 1, wherein said maximum opening detecting circuit includes an intake air volume sensor for detecting the intake air volume and for increasing the predetermined value for the maximum opening of said bypass valve in accordance with the increase of the intake air volume.

6. The improvement according to claim 1, wherein said maximum opening detecting circuit includes:

a throttle position sensor for detecting the position of said throttle valve; and a temperature detecting device for detecting the temperature of said engine, whereby the predetermined value for the maximum opening of said bypass valve is determined by the combination of the outputs from said throttle position sensor and said temperature detecting device.

* * * * *